US012680233B2

(12) United States Patent
Tirimacco

(10) Patent No.: US 12,680,233 B2
(45) Date of Patent: Jul. 14, 2026

(54) DURABLE TISSUE PRODUCT

(71) Applicant: Kimberly-Clark Worldwide, Inc., Neenah, WI (US)

(72) Inventor: Maurizio Tirimacco, Minneapolis, MN (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 152 days.

(21) Appl. No.: 18/436,790

(22) Filed: Feb. 8, 2024

(65) Prior Publication Data

US 2024/0183110 A1 Jun. 6, 2024

Related U.S. Application Data

(63) Continuation of application No. 17/048,857, filed as application No. PCT/US2018/029859 on Apr. 27, 2018, now Pat. No. 12,012,698.

(51) Int. Cl.

| | |
|---|---|
| ***D21H 27/00*** | (2006.01) |
| ***D21F 11/04*** | (2006.01) |
| ***D21H 11/04*** | (2006.01) |
| ***D21H 15/06*** | (2006.01) |
| ***D21H 17/07*** | (2006.01) |
| ***D21H 19/22*** | (2006.01) |
| ***D21H 27/02*** | (2006.01) |
| ***D21H 27/38*** | (2006.01) |

(52) U.S. Cl.

CPC ..... *D21H 27/005* (2013.01); *D21F 11/04* (2013.01); *D21H 11/04* (2013.01); *D21H 15/06* (2013.01); *D21H 17/07* (2013.01); *D21H 19/22* (2013.01); *D21H 27/02* (2013.01); *D21H 27/38* (2013.01)

(58) Field of Classification Search

CPC ..... D21H 27/005; D21H 11/04; D21H 15/06; D21H 17/07; D21H 19/22; D21H 27/02; D21H 27/38; D21F 11/04

See application file for complete search history.

(56) References Cited

U.S. PATENT DOCUMENTS 5,320,710 A 6/1994 Reeves et al.
5,405,501 A 4/1995 Phan et al.
(Continued)

FOREIGN PATENT DOCUMENTS

CN 102028423 A 4/2011

*Primary Examiner* — Abbas Rashid
*Assistant Examiner* — Stephen M Russell
(74) *Attorney, Agent, or Firm* — KIMBERLY-CLARK WORLDWIDE, INC.

(57) ABSTRACT

The present invention provides a durable tissue product produced from a tissue web that has been manufactured by applying a binder, such as by printing, to one side of the web and then contacting the binder applied side to a rotating dryer and creping the web therefrom. The side of the web opposite of the binder applied side is generally not treated with a binder, or the like, and is not subjected to creping. Further, the opposite side is generally formed from a layer of short, low coarseness cellulosic fibers, such as hardwood kraft fibers, and may be substantially free from long cellulosic fibers, such as softwood fibers. Despite forming the untreated surface from short fibers, the tissue product has good durability, such as a slough from about 6.0 to about 9.0 mg.

11 Claims, 3 Drawing Sheets

(56) References Cited

U.S. PATENT DOCUMENTS

| | | | | |
|---|---|---|---|---|
| 5,981,044 | A * | 11/1999 | Phan | D21H 17/07 162/149 |
| 2003/0121627 | A1* | 7/2003 | Hu | D21F 11/04 162/168.3 |
| 2008/0216977 | A1 | 9/2008 | Dyer et al. | |
| 2013/0029105 | A1* | 1/2013 | Miller | D21H 21/18 428/219 |
| 2014/0000823 | A1* | 1/2014 | Salminen | D01B 1/14 162/123 |
| 2014/0041820 | A1 | 2/2014 | Ramaratnam et al. | |
| 2017/0314207 | A1 | 11/2017 | Sealey, II et al. | |

* cited by examiner

DURABLE TISSUE PRODUCT

BACKGROUND

Absorbent paper products such as paper towels, facial tissues and other similar products are designed to include several important properties. For example, the products should have good bulk, a soft feel and should be highly absorbent. The product should also have good strength even while wet and should resist tearing. Unfortunately, it is very difficult to produce a high strength paper product that is also soft and highly absorbent. Usually, when steps are taken to increase one property of the product, other characteristics of the product are adversely affected. For instance, softness is typically increased by decreasing or reducing fiber bonding within the paper product. Inhibiting or reducing fiber bonding, however, adversely affects the strength of the paper web.

One particular process that has proved to be very successful in producing paper towels and wipers is disclosed in U.S. Pat. No. 3,879,257. The process involves applying a bonding material in a fine, spaced apart pattern to one side of a fibrous web. The web is then adhered to a heated creping surface and creped from the surface. A bonding material is applied to the opposite side of the web and the web is similarly creped. The process produces wiper products having exceptional bulk, outstanding softness and good absorbency. The surface regions of the web also provide excellent strength, abrasion resistance, and wipe-dry properties.

Although the process and products disclosed in U.S. Pat. No. 3,879,257 have provided many advances in the art of making paper wiping products, further improvements in various aspects of paper wiping products remain desired. For example, the products are relatively expensive to produce not only from a materials standpoint but also from the amount of processing that is required to produce the product. A need currently exists for a more economical tissue product that has similar properties to a double printed and double creped tissue product as disclosed in U.S. Pat. No. 3,879,257.

SUMMARY

It has now been surprisingly discovered that a low cost, yet durable, multi-layered tissue product may be produced by selectively disposing short, low coarseness cellulosic fibers, such as hardwood kraft pulp fibers and more preferably Eucalyptus hardwood kraft fibers, in one of the outer layers of the product and applying a binder to the other outer layer. The tissue products can be, for instance, paper towels, industrial wipers, facial tissues, bath tissues, napkins, and the like.

Accordingly, in one embodiment the present invention provides a durable tissue product produced from a tissue web that has been manufactured by applying a binder, such as by printing, to one side of the web and then contacting the binder applied side to a rotating drying drum and creping the web therefrom. The side of the web opposite of the binder applied side is generally not treated with a binder, or the like, and is not subjected to creping. Further, the opposite side is generally formed from a layer of short, low coarseness cellulosic fibers, such as hardwood kraft fibers, and may be substantially free from long cellulosic fibers, such as softwood fibers. Despite forming the untreated surface from short, low coarseness cellulosic fibers, the tissue product has good durability, such as a slough less than about 10 mg and more preferably less than about 9.0 mg, such as from about 6.0 to about 9.0 mg, such as from about 6.0 to about 8.0 mg, such as from about 6.0 to about 7.5 mg.

In another embodiment the present invention provides a tissue product comprising a multi-layered web having a first outer fibrous layer comprising long cellulosic fibers forming an upper surface of the product and a second outer fibrous layer comprising short, cellulosic fibers forming the bottom surface of the product and a middle layer disposed there between; and a binder disposed on the upper surface of the product, wherein the tissue product has a slough less than about 10 mg and more preferably less than about 9.0 mg, such as from about 6.0 to about 9.0 mg.

In still another embodiment the present invention provides a single ply tissue product consisting of a multi-layered web where one or more of the outer most layers consist essentially of hardwood kraft fibers and are not treated with a binder, or the like. For example, the multi-layered web may comprise two outer layers and a middle layer, where at least one of the outer layers are substantially free from long cellulosic fibers and the middle layer comprises long cellulosic fibers, such as Northern softwood kraft (NSWK) or Southern softwood kraft (SSWK).

In yet another embodiment the present invention provides a single ply creped, through-air dried tissue product comprising a first outer fibrous layer forming an upper surface of the product, a second outer fibrous layer consisting essentially of hardwood kraft pulp fibers forming a lower surface of the product, and a binder disposed on the first outer layer, wherein the product has a slough from about 6.0 to about 9.0 mg.

In other embodiments the present invention provides a method of forming a durable multi-layered tissue product comprising the steps of: (a) dispersing short, low coarseness pulp fibers in water to form a first fiber slurry: (b) dispersing long pulp fibers in water to form a second fiber slurry; (c) dispersing long pulp fibers in water to form a third fiber slurry; (d) depositing the first, second and third fiber slurries in a layered arrangement on a moving belt to form a multi-layered tissue web, wherein the first fiber slurry contacts the moving belt and forms a first outer surface of the web and the third fiber slurry contacts the air and forms a second outer surface of the web and the second fiber slurry is disposed between the first and third fiber slurries; (e) applying a binder to the second outer surface of the web according to a first preselected pattern; (f) creping the second outer surface of the web after application of the binder; and (g) converting the creped web into a tissue product having a slough less than about 9.0 mg.

DEFINITIONS

Figure 1:
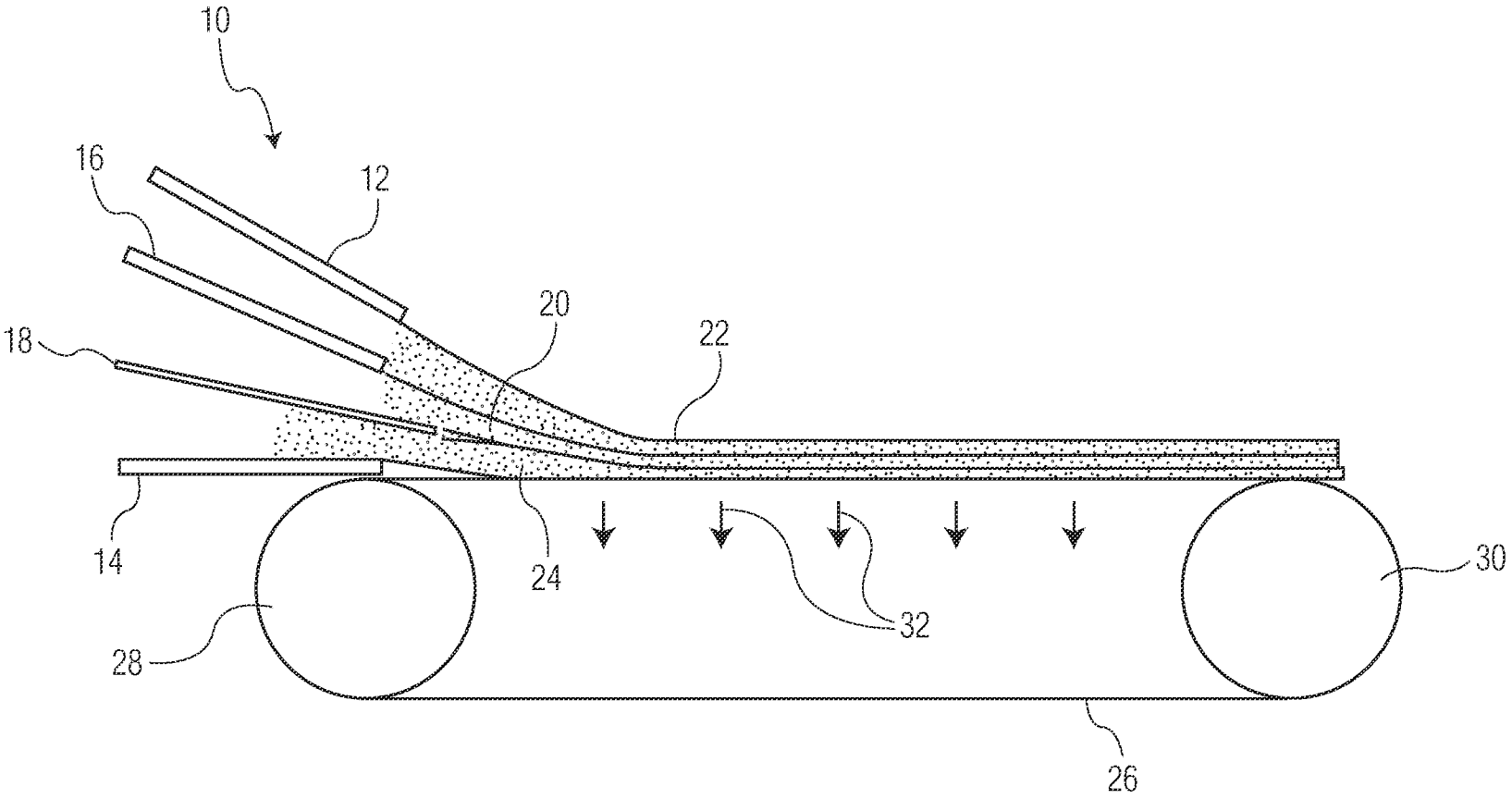
FIG. 1 illustrates one embodiment for forming a multi-layered tissue web according to the present invention.

As used herein, a "Tissue Product" generally refers to various paper products, such as facial tissue, bath tissue, paper towels, napkins, and the like. Normally, the basis weight of a tissue product of the present invention is less than about 120 grams per square meter (gsm), such as less than about 100 gsm, such as less than about 80 gsm, and in some embodiments may range from about 10 to about 80 gsm and more preferably from about 20 to about 60 gsm.

As used herein, the term "Basis Weight" generally refers to the bone dry weight per unit area of a tissue and is generally expressed as grams per square meter (gsm). Basis weight is measured using TAPPI test method T-220.

As used herein, the term "Layer" refers to a plurality of strata of fibers, chemical treatments, or the like within a ply.

As used herein, the terms "Layered Tissue Web," "multi-layered tissue web." "multi-layered web," and "multi-layered paper sheet," generally refer to sheets of paper prepared from two or more layers of aqueous papermaking furnish which are preferably comprised of different fiber types. The layers are preferably formed from the deposition of separate streams of dilute fiber slurries, upon one or more endless foraminous screens. If the individual layers are initially formed on separate foraminous screens, the layers are subsequently combined (while wet) to form a layered composite web.

The term "Ply" refers to a discrete product element. Individual plies may be arranged in juxtaposition to each other. The term may refer to a plurality of web-like components such as in a multi-ply facial tissue, bath tissue, paper towel, wipe, or napkin.

As used herein, the term "TEA Index" refers the geometric mean tensile energy absorption (typically expressed in $g \cdot cm/cm^2$) at a given geometric mean tensile strength (typically having units of grams per three inches) as defined by the equation:

$$TEA\ \text{Index} = \frac{GM\ TEA\ (g \cdot cm/cm2)}{GMT\ (g/3'')} \times 1{,}000$$

While the TEA Index may vary, tissue products prepared according to the present disclosure may, in certain embodiments, have a TEA Index greater than about 5.0, more preferably greater than about 5.5 and still more preferably greater than about 6.0, such as from about 5.0 to about 8.0.

As used herein, the term "Caliper" is the representative thickness of a single sheet (caliper of tissue products comprising one or more plies is the thickness of a single sheet of tissue product comprising all plies) measured in accordance with TAPPI test method T402 using a ProGage 500 Thickness Tester (Thwing-Albert Instrument Company, West Berlin, NJ). The micrometer has an anvil diameter of 2.22 inches (56.4 mm) and an anvil pressure of 132 grams per square inch (per 6.45 square centimeters) (2.0 kPa).

As used herein, the term "Sheet Bulk" refers to the quotient of the caliper (μm) divided by the bone dry basis weight (gsm). The resulting sheet bulk is expressed in cubic centimeters per gram (cc/g). Tissue products prepared according to the present invention may, in certain embodiments, have a sheet bulk greater than about 10 cc/g, more preferably greater than about 11 cc/g and still more preferably greater than about 12 cc/g.

As used herein, the term "Fiber Length" refers to the length weighted average fiber length (LWAFL) of fibers determined utilizing an OpTest Fiber Quality Analyzer-360 (OpTest Equipment, Inc., Hawkesbury, ON). The length weighted average fiber length is determined in accordance with the manufacturer's instructions and generally involves first accurately weighing a pulp sample (10-20 mg for hardwood, 25-50 mg for softwood) taken from a one-gram handsheet made from the pulp. The moisture content of the handsheet should be accurately known so that the actual amount of fiber in the sample is known. This weighed sample is then diluted to a known consistency (between about 2 and about 10 mg/l) and a known volume (usually 200 ml) of the diluted pulp is sampled. This 200 ml sample is further diluted to 600 ml and placed in the analyzer. The length weighted average fiber length is defined as the sum of the product of the number of fibers measured and the length of each fiber squared divided by the sum of the product of the number of fibers measured and the length of the fiber. Fiber lengths are generally reported in millimeters.

As used here, the term "Coarseness" generally refers to the weight per unit length of fiber, commonly having units of mg/100 meters. Coarseness is measured according to ISO Coarseness Testing Method 23713 utilizing an OpTest Fiber Quality Analyzer-360 (OpTest Equipment, Inc., Hawkesbury, ON).

As used herein, the term "Slope" refers to slope of the line resulting from plotting tensile versus stretch and is an output of the MTS TestWorks™ in the course of determining the tensile strength as described in the Test Methods section herein. Slope is reported in the units of grams (g) per unit of sample width (inches) and is measured as the gradient of the least-squares line fitted to the load-corrected strain points falling between a specimen-generated force of 70 to 157 grams (0.687 to 1.540 N) divided by the specimen width.

As used herein, the term "Geometric Mean Slope" (GM Slope) generally refers to the square root of the product of machine direction slope and cross-machine direction slope. While the GM Slope may vary amongst tissue products prepared according to the present disclosure, in certain embodiments, tissue products have a GM Slope less than about 12,500 g, more preferably less than about 12,000 g and still more preferably less than about 11.500 g, such as from about 9,000 to about 12,500 g.

As used herein, the terms "Geometric Mean Tensile" (GMT) refer to the square root of the product of the machine direction tensile strength and the cross-machine direction tensile strength of the web. While the GMT may vary, tissue products prepared according to the present disclosure may, in certain embodiments, have a GMT greater than about 1,000 g/3", and more preferably greater than about 1,200 g/3" and still more preferably greater than about 1,400 g/3", such as from about 1,000 to about 1,600 g/3".

As used herein, the term "Stiffness Index" refers to the quotient of the geometric mean tensile slope, defined as the square root of the product of the MD and CD slopes (typically having units of kg), divided by the geometric mean tensile strength (typically having units of grams per three inches).

$$\text{Stiffness Index} = \frac{\sqrt{MD\ \text{Tensile Slope (kg)} \times CD\ \text{Tensile Slope(kg)}}}{GMT\ (g/3'')} \times 1{,}000$$

While the Stiffness Index may vary, tissue products prepared according to the present disclosure may, in certain embodiments, have a Stiffness Index less than about 7.50, more preferably less than about 7.00 and still more preferably less than about 6.75, such as from about 6.00 to about 7.50.

As used herein, the term "Slough" refers to the undesirable sloughing off of bits of the tissue web from the surface that has not been subjected to treatment with a creping material, such as binder, and has not been brought into contact with the creping surface when rubbed and is generally measured as described in the Test Methods section below. Slough is generally reported in terms of mass, such as milligrams. While slough may vary, tissue products prepared according to the present disclosure may, in certain embodiments, have a slough less than about 10 mg, such as less than about 9.5 mg, such as less than about 9.0 mg, such as from about 6.0 to about 10 mg and more preferably from about 6.0 to about 9.0 mg, such as from about 6.0 to about 8.0 mg, such as from about 6.0 to about 7.5 mg.

As used herein the term "Tensile Ratio" generally refers to the ratio of machine direction (MD) tensile (having units of g/3") and the cross-machine direction (CD) tensile (having units of g/3"). While the Tensile Ratio may vary tissue products prepared according to the present disclosure may, in certain embodiments, have a Tensile Ratio less than about 2.0, such as from about 1.0 to about 2.0.

DETAILED DESCRIPTION

The present invention generally provides a tissue product having good surface durability, generally measured herein as slough, such as a slough less than about 10 mg, such as less than about 9.5 mg, such as less than about 9.0 mg, such as from about 6.0 to about 10 mg and more preferably from about 6.0 to about 9.0 mg. The present tissue products not only have good surface durability, but are formed from an economical blend of papermaking fibers. Previously, it had been believed that to achieve good surface durability it was necessary that the surface of the web either be treated with a binder or comprise long, low-coarseness fibers having a high degree of inter-fiber bonding. For example, previously it was customary for the surface of the tissue product to comprise Northern softwood kraft fibers, which have a relatively low fiber coarseness, such as less than about 17 mg/100 m and are susceptible to a relatively high degree of inter-fiber bonding.

It has now been discovered that one of the outer surfaces of the tissue product may comprise short, low-coarseness fibers, such as hardwood kraft pulp fibers and more particularly eucalyptus kraft pulp fibers, and be substantially free from binder and still have good surface durability, such as a slough less than about 10 mg, such as less than about 9.5 mg, such as less than about 9.0 mg, such as from about 6.0 to about 10 mg and more preferably from about 6.0 to about 9.0 mg.

Accordingly, one of the outer surfaces of the tissue product comprises short, low-coarseness fibers, such as hardwood kraft pulp fibers and more particularly Eucalyptus kraft pulp fibers and may be substantially free from long cellulosic fibers, such as softwood fibers, and binder and still have good durability, such as slough less than about 10 mg and more preferably less than about 9.0 mg, such as from about 6.0 to about 9.0 mg. It should be understood that, when referring to a layer that is substantially free from substances, such as long cellulosic fibers, negligible amounts of the fibers may be present therein, however, such small amounts often arise from the long cellulosic fibers applied to an adjacent layer, and do not typically substantially affect the durability, such as the slough, or other physical characteristics of the web.

The tissue products and webs of the present invention are generally formed from multiple layers of fiber furnish. The web can be produced, for instance, from a stratified headbox. Layered structures produced by any means known in the art are within the scope of the present invention, including those disclosed in U.S. Pat. No. 5,494,554, which is incorporated herein by reference in a manner consistent with the present disclosure.

Preferably a layered or stratified web is formed that contains short, low-coarseness cellulosic fibers in at least one of the outer layers. Generally the short, low-coarseness cellulosic fibers have a fiber length less than about 2.0 mm, such as less than about 1.5 mm, such as less than about 1.0 mm, such as from about 0.50 to about 2.0 and more preferably from about 0.70 to about 1.50 mm. The short, low-coarseness cellulosic fibers may have a coarseness less than about 17 mg/100 m, such as less than about 15 mg/100 m, such as less than about 12 mg/100 m, such as from about 5.0 to about 17 mg/100 m and more preferably from about 5.0 to about 12 mg/100 m.

In one embodiment the short, low-coarseness cellulosic fibers may be derived from deciduous hardwood trees, and may be selected from the group consisting of Acacia, Eucalyptus, Maple, Oak, Aspen, Birch, Cottonwood, Alder, Ash, Cherry, Elm, Hickory, Poplar, Gum, Walnut, Locust, Sycamore, Beech, Catalpa, Sassafras, Gmelina, Albizia, Anthocephalus, Magnolia, Bagasse, Flax, Hemp. Kenaf, and combinations thereof. In another embodiment the hardwood fiber is selected from the group consisting of Eucalyptus, Aspen, Birch, Beech, Oak, Maple, Gum, and combinations thereof; in another embodiment Eucalyptus. In a particularly preferred embodiment the short, low-coarseness cellulosic fibers comprise bleached Eucalyptus kraft pulp fibers.

The short, low-coarseness cellulosic fibers are generally arranged in the web such that they make up at least one layer of the stratified web and more preferably an outer layer of the web such that the fibers form an outer surface of the resulting tissue product. For example, in one particular embodiment of the present invention, the web comprises first and second outer layers forming the first and second surfaces of the web, and a middle layer disposed there between. Each outer layer can comprise from about 15 to about 40 percent by weight of the web and particularly from about 20 to about 35 percent by weight of the web. The middle layer, however, can comprise from about 40 to about 60 percent by weight of the web, and particularly about 50 percent by weight of the web.

In one embodiment, one of the product's outer layers consists essentially of short, low-coarseness cellulosic fibers and the layer comprises from about 20 to about 40 percent by weight of the product. For example, the product may comprise first and second outer layers and at least one of the outer layers consists essentially of short, low-coarseness cellulosic fibers, such as bleached Eucalyptus kraft pulp fibers. In other embodiments, only one of the outer layers consist essentially of short, low-coarseness cellulosic fibers and the layer comprises from about 20 to about 40 percent by weight of the web.

In certain embodiments the middle layer can contain kraft pulp fibers, such as softwood kraft pulp fibers, or a mixture of kraft pulp fibers and high yield pulp fibers. For example, the middle layer may comprise a mixture of Northern softwood kraft pulp fibers and bleached chemi-thermomechanical pulp (BCTMP) fibers, where the BCTMP fibers are present in the middle layer in an amount from about 40 to about 60 percent by weight of the middle layer, and particularly in an amount of about 50 percent by weight of the middle layer.

In certain embodiments the middle layer of the multi-layered web may be formed without a substantial amount of inner fiber-to-fiber bond strength. In this regard, the fiber furnish used to form the middle layer can be treated with a chemical debonding agent. The debonding agent can be added to the fiber slurry during the pulping process or can be added directly into the headbox. Suitable debonding agents that may be used in the present invention include cationic debonding agents, particularly quaternary ammonium compounds, mixtures of quaternary ammonium compounds with polyhydroxy compounds, and modified polysiloxanes.

Suitable cationic debonding agents include, for example, fatty dialkyl quaternary amine salts, mono fatty alkyl tertiary amine salts, primary amine salts, imidazoline quaternary salts, silicone quaternary salt and unsaturated fatty alkyl amine salts. Other suitable debonding agents are disclosed in U.S. Pat. No. 5,529,665, the contents of which are incorporated herein in a manner consistent with the present disclosure.

In one embodiment, the debonding agent used in the process of the present invention is an organic quaternary ammonium chloride and particularly a silicone based amine salt of a quaternary ammonium chloride. Useful debonders are commercially available under the tradename ProSoft (commercially available from Solenis, Wilmington, DE). The debonding agent can be added to the fiber slurry in an amount of from about 1.0 kg per metric tonne to about 15 kg per metric tonne of fibers present within the slurry.

Particularly useful quaternary ammonium debonders include imidazoline quaternary ammonium debonders, such as oleyl-imidazoline quaternaries, dialkyl dimethyl quaternary debonders, ester quaternary debonders, diamidoamine quaternary debonders, and the like. The imidazoline-based debonding agent can be added in an amount of between 1.0 to about 10 kg per metric tonne.

In certain embodiments the tissue product of the present invention is formed from a basesheet comprising first and second outer layers and a middle layer disposed there between where the first outer layer comprises softwood fibers, the middle layer comprises softwood kraft fibers and the second outer layer comprises short, low-coarseness cellulosic fibers. For example, in one particular embodiment of the present invention, the paper web contains a first outer layer comprising Northern softwood kraft fibers, which comprises from about 25 to about 35 percent by weight of the web, the middle layer comprises softwood kraft fibers, and comprises from about 35 to about 45 percent by weight of the web and the second outer layer comprises bleached Eucalyptus kraft fibers, which comprises from about 25 to about 35 percent by weight of the web.

In another embodiment, a layer or other portion of the web, including the entire web, can be provided with wet or dry strength agents. As used herein, "wet strength agents" are materials used to immobilize the bonds between fibers in the wet state. Any material that when added to a paper web or sheet at an effective level results in providing the sheet with a wet geometric tensile strength:dry geometric tensile strength ratio in excess of 0.1 will, for purposes of this invention, be termed a wet strength agent. Typically these materials are termed either as permanent wet strength agents or as "temporary" wet strength agents. For the purposes of differentiating permanent from temporary wet strength, permanent will be defined as those resins which, when incorporated into paper or tissue products, will provide a product that retains more than 50 percent of its original wet tensile strength after exposure to water for a period of at least five minutes. Temporary wet strength agents are those which show less than 50 percent of their original wet strength after being saturated with water for five minutes. Both classes of material find application in the present invention. The amount of wet strength agent or dry strength added to the pulp fibers can be at least about 0.1 dry weight percent, more specifically about 0.2 dry weight percent or greater, and still more specifically from about 0.1 to about 3 dry weight percent, based on the dry weight of the fibers.

Particularly preferred wet strength agents include resin binder materials selected from the group consisting of polyamide-epichlorohydrin resins, polyacrylamide resins, and mixtures thereof. Of particular utility are the various polyamide-epichlorohydrin resins. These materials are low molecular weight polymers provided with reactive functional groups such as amino, epoxy, and azetidinium groups. Particularly useful polyamide-epichlorohydrin resins include those marketed under the tradename KYMENE (Solenis, Wilmington, DE).

Useful dry strength additives include carboxymethyl cellulose resins, starch based resins, and mixtures thereof. Examples of preferred dry strength additives include carboxymethyl cellulose, and cationic polymers available under the tradename ACCO (commercially available from American Cyanamid Company, Wayne, NJ) such as ACCO 711 and ACCO 514.

Suitable temporary wet strength resins include, but are not limited to, those resins described in U.S. Pat. Nos. 3,556,932 and 3,556,933. Other temporary wet strength agents that should find application in this invention include modified starches.

Although wet strength agents as described above find particular advantage for use in connection with this invention, other types of bonding agents can also be used to provide the necessary wet resiliency. They can be applied at the wet end of the basesheet manufacturing process or applied by spraying or printing after the basesheet is formed or after it is dried.

Referring to FIG. 1, one embodiment of a device for forming a multi-layered stratified pulp furnish is illustrated. As shown, a three-layered headbox 10 generally includes an upper headbox wall 12 and a lower headbox wall 14. Headbox 10 further includes a first divider 16 and a second divider 18, which separate three fiber stock layers.

Each of the fiber layers comprises a dilute aqueous suspension of papermaking fibers. In one embodiment, for instance, middle layer 20 contains softwood kraft fibers either alone or in combination with other fibers such as high yield fibers. At least one of the outer layers 22 and 24, on the other hand, contain short, low coarseness cellulosic fibers, such as hardwood kraft pulp fibers and more preferably Eucalyptus kraft pulp fibers.

An endless traveling forming fabric 26, suitably supported and driven by rolls 28 and 30, receives the layered papermaking stock issuing from headbox 10. Once retained on fabric 26, the layered fiber suspension passes water through the fabric as shown by the arrows 32. Water removal is achieved by combinations of gravity, centrifugal force and vacuum suction depending on the forming configuration.

Forming multi-layered paper webs is also described and disclosed in U.S. Pat. No. 5,129,988, the contents of which are incorporated herein in a manner consistent with the present disclosure.

The basis weight of paper webs used in the process of the present invention can vary depending upon the final product. For example, the process of the present invention can be used to produce facial tissues, bath tissues, paper towels, industrial wipers, and the like. For these products, the basis weight of the paper web can vary from about 10 to about 120 gsm, and particularly from about 35 to about 80 gsm. In one particular embodiment, it has been discovered that the present invention is particularly well suited for the production of wiping products having a basis weight of from about 50 to about 65 gsm.

As stated above, the manner in which the paper web is formed can also vary depending upon the particular application. In general, the paper web can be formed by any of a variety of papermaking processes known in the art. For example, the paper web may comprise a through-air dried web such as an uncreped through-air dried web. Other through-air dried webs that may be used in the present invention include pattern-densified or imprinted webs. In another alternative embodiment, the tissue web may be made according to an air forming process.

Figure 2:
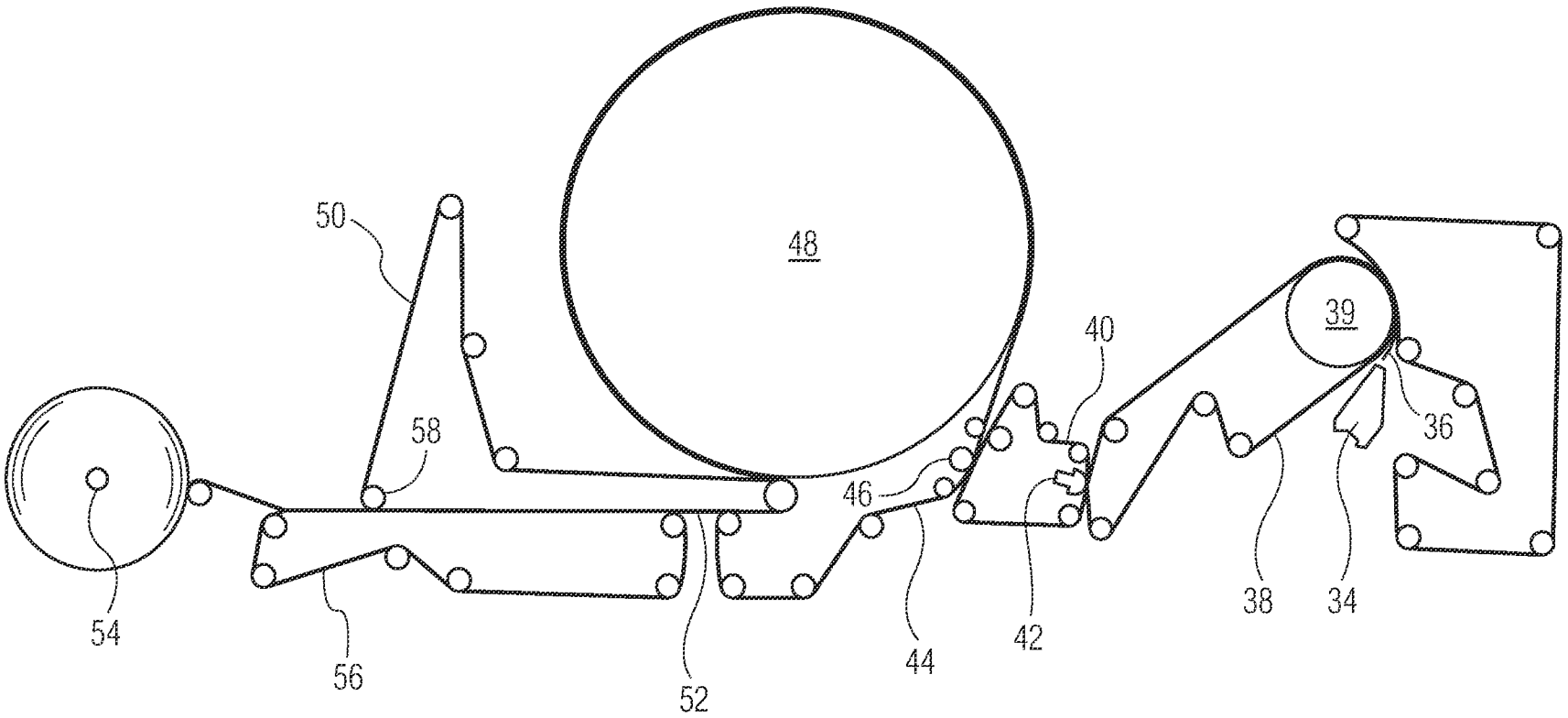
FIG. 2 illustrates one embodiment for forming a basesheet useful in the production of a durable creped tissue according to the present invention.

For example, referring to FIG. 2, shown is a method for making through-air dried paper sheets that may be used in accordance with this invention. (For simplicity, the various tensioning rolls schematically used to define the several fabric runs are shown but not numbered. It will be appreciated that variations from the apparatus and method illustrated in FIG. 2 can be made without departing from the scope of the invention). Shown is a twin wire former having a papermaking headbox 34, such as a layered headbox, which injects or deposits a stream 36 of an aqueous suspension of papermaking fibers onto the forming fabric 38 positioned on a forming roll 39. The forming fabric serves to support and carry the newly-formed wet web downstream in the process as the web is partially dewatered to a consistency of about 10 dry weight percent. Additional dewatering of the wet web can be carried out, such as by vacuum suction, while the wet web is supported by the forming fabric.

The wet web is then transferred from the forming fabric to a transfer fabric 40. In one embodiment, the transfer fabric can be traveling at a slower speed than the forming fabric in order to impart increased stretch into the web. This is commonly referred to as a "rush" transfer. Preferably the transfer fabric can have a void volume that is equal to or less than that of the forming fabric. The relative speed difference between the two fabrics can be from 0 to 60 percent, more specifically from about 15 to 45 percent. Transfer is preferably carried out with the assistance of a vacuum shoe 42 such that the forming fabric and the transfer fabric simultaneously converge and diverge at the leading edge of the vacuum slot.

The web is then transferred from the transfer fabric to the throughdrying fabric 44 with the aid of a vacuum transfer roll 46 or a vacuum transfer shoe, optionally again using a fixed gap transfer as previously described. The throughdrying fabric can be traveling at about the same speed or a different speed relative to the transfer fabric. If desired, the throughdrying fabric can be run at a slower speed to further enhance stretch. Transfer can be carried out with vacuum assistance to ensure deformation of the sheet to conform to the throughdrying fabric, thus yielding desired bulk and texture. Suitable throughdrying fabrics are described in U.S. Pat. Nos. 5,429,686 and 5,672,248, which are incorporated by reference.

In one embodiment, the throughdrying fabric contains high and long impression knuckles. For example, the throughdrying fabric can have from about 5 to about 300 impression knuckles per square inch which are raised at least about 0.005 inches above the plane of the fabric. During drying, the web can be macroscopically arranged to conform to the surface of the throughdrying fabric and form a textured, three-dimensional surface.

The side of the web contacting the throughdrying fabric is typically referred to as the "fabric side" of the paper web. The fabric side of the paper web, as described above, may have a shape that conforms to the surface of the throughdrying fabric after the fabric is dried in the throughdryer. The opposite side of the paper web, on the other hand, is typically referred to as the "air side". The air side of the web may be smoother than the fabric side during normal throughdrying processes.

The level of vacuum used for the web transfers can be from about 3 to about 15 inches of mercury (75 to about 380 millimeters of mercury), preferably about 5 inches (125 millimeters) of mercury. The vacuum shoe (negative pressure) can be supplemented or replaced by the use of positive pressure from the opposite side of the web to blow the web onto the next fabric in addition to or as a replacement for sucking it onto the next fabric with vacuum. Also, a vacuum roll or rolls can be used to replace the vacuum shoe(s).

While supported by the throughdrying fabric, the web is dried to a consistency of about 94 percent or greater by the throughdryer 48 and thereafter transferred to a carrier fabric 50. The dried basesheet 52 is transported to the reel 54 using carrier fabric 50 and an optional carrier fabric 56. An optional pressurized turning roll 58 can be used to facilitate transfer of the web from carrier fabric 50 to fabric 56. Suitable carrier fabrics for this purpose are Albany International 84M or 94M and Asten 959 or 937, all of which are relatively smooth fabrics having a fine pattern. Although not shown, reel calendering or subsequent off-line calendering or embossing may be used.

In one embodiment, the reel 54 shown in FIG. 2 can run at a speed slower than the fabric 56 in a rush transfer process for building bulk into the paper web 52. For instance, the relative speed difference between the reel and the fabric can be from about 5 to about 25 percent and, particularly from about 12 to about 14 percent. Rush transfer at the reel can occur either alone or in conjunction with a rush transfer process upstream, such as between the forming fabric and the transfer fabric.

In one embodiment, the paper web 52 is a textured web which has been dried in a three-dimensional state such that the hydrogen bonds joining fibers were substantially formed while the web was not in a flat, planar state. For instance, the web can be formed while the web is on a highly textured throughdrying fabric or other three-dimensional substrate. Processes for producing uncreped throughdried fabrics are, for instance, disclosed in U.S. Pat. Nos. 5,672,248, 5,656,132 and 6,096,169.

Figure 3:
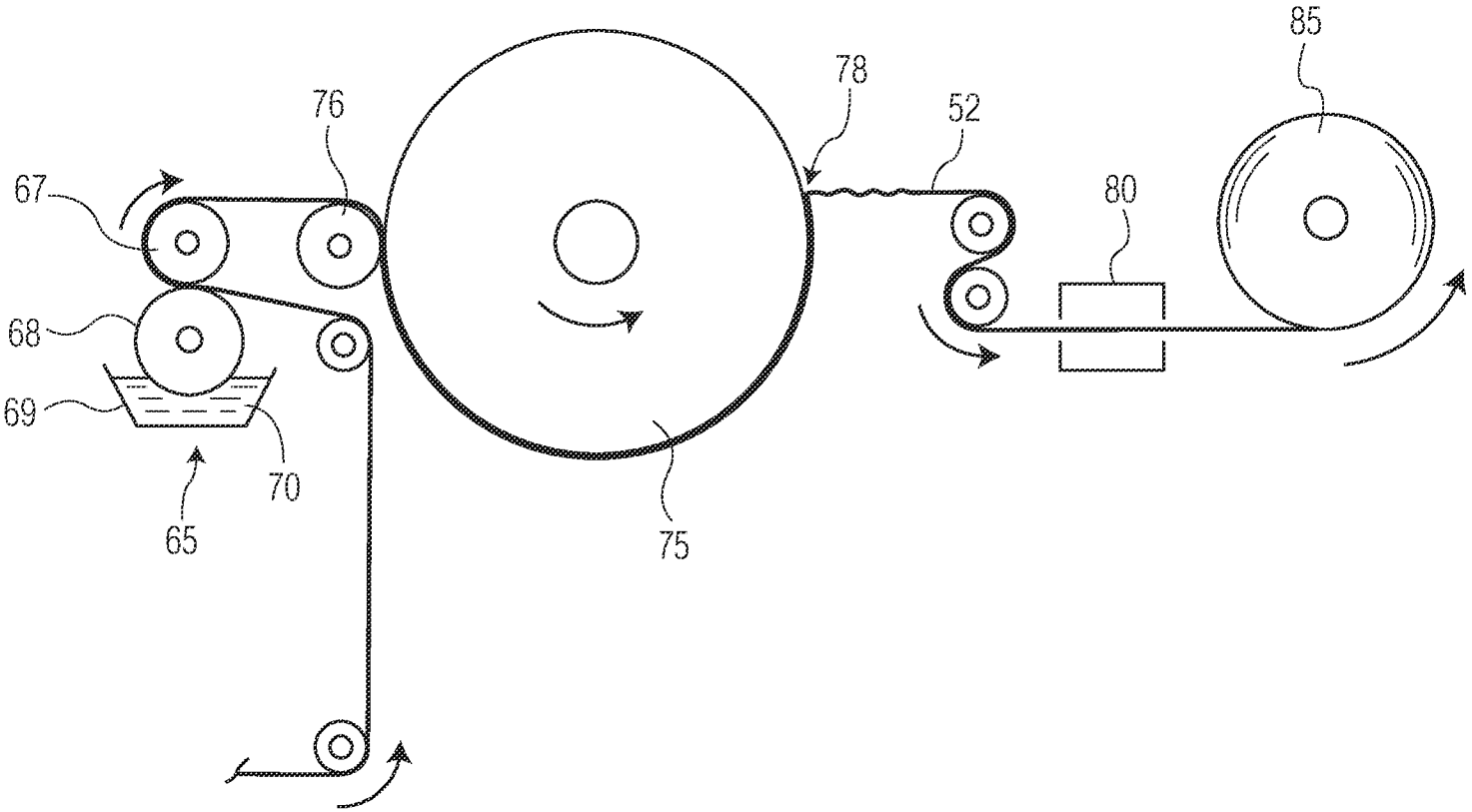
FIG. 3 illustrates one embodiment for printing a binder onto a basesheet and creping the basesheet to produce a durable creped tissue according to the present invention.

Once the paper web is formed, a bonding material is applied to at least one side of the web and the treated side of the web is then creped. FIG. 3 is a schematic representation of a print/crepe process in which a flexible polymeric binder material is applied to one outer surface of the throughdried basesheet as produced in accordance with FIG. 2. Although gravure printing of the binder is illustrated, other means of applying the flexible polymeric binder material can also be used, such as foam application, spray application, flexographic printing, or digital printing methods, such as ink jet printing, and the like. Shown is paper web 52 passing through a flexible polymeric binder material application station 65. Station 65 includes a transfer roll 67 in contact with a rotogravure roll 68, which is in communication with a reservoir 69 containing a suitable binder 70. The flexible polymeric binder material 70 is applied to one side of the web 52 in a pre-selected pattern. Preferably the side of the web 52 that is treated with the binder material 70 is formed from a layer of long cellulosic fibers and more preferably long, low coarseness cellulosic fibers such as Northern softwood kraft fibers.

After the flexible polymeric binder material 70 is applied, the sheet 52 is adhered to a creping roll 75 by a press roll 76. The sheet 52 is carried on the surface of the creping roll 75 for a distance and then removed therefrom by the action of a creping blade 78. The creping blade 78 performs a controlled pattern creping operation on the side of the sheet 52 to which the flexible polymeric binder material 70 was applied.

Once creped, the sheet 52 is pulled through an optional drying station 80. The drying station can include any form of a heating unit, such as an oven energized by infrared heat, microwave energy, hot air, or the like. Alternatively, the drying station may comprise other drying methods such as photo-curing, UV-curing, corona discharge treatment, electron beam curing, curing with reactive gas, curing with heated air such as through-air heating or impingement jet heating, infrared heating, contact heating, inductive heating, microwave or RF heating, and the like. The drying station may be necessary in some applications to dry the sheet and/or cure the flexible polymeric binder material. Depending upon the flexible polymeric binder material selected, however, drying station 80 may not be needed. Once passed through the drying station 80, the sheet 52 can be wound into a roll of material or product 85.

The bonding materials applied to each side of the paper web are selected for not only assisting in creping the web but also for adding dry strength, wet strength, stretchability, and tear resistance to the tissue web. Particular bonding materials that may be used in the present invention include latex compositions, such as carboxylated vinyl acetate-ethylene terpolymers, acrylates, vinyl acetates, vinyl chlorides and methacrylates. Some water-soluble bonding materials may also be used including polyacrylamides, polyvinyl alcohols and cellulose derivatives such as carboxymethyl cellulose. Other bonding materials include styrene-butadiene copolymers, polyvinyl acetate polymers, vinyl-acetate ethylene copolymers, vinyl-acetate acrylic copolymers, ethylene-vinyl chloride copolymers, ethylene-vinyl chloride-vinyl acetate terpolymers, acrylic polyvinyl chloride polymers, nitrile polymers, and the like. Other examples of suitable latex polymers may be described in U.S. Pat. No. 3,844,880.

In one embodiment, the bonding materials used in the process of the present invention comprise an ethylene vinyl acetate copolymer. In particular, the ethylene vinyl acetate copolymer can be cross-linked with N-methyl acrylamide groups using an acid catalyst. Suitable acid catalysts include ammonium chloride, citric acid and maleic acid.

The bonding materials are applied to the base web as described above in a preselected pattern. In one embodiment, for instance, the bonding materials can be applied to the web in a reticular pattern, such that the pattern is interconnected forming a net-like design or grid on the surface.

In an alternative embodiment, however, the bonding materials are applied to the web in a pattern that represents a succession of discrete shapes. Applying the bonding material in discrete shapes, such as dots, provides sufficient strength to the web without covering a substantial portion of the surface area of the web.

According to the present invention, the bonding materials are applied to only one side of the web so as to cover from about 15 to about 75 percent of the surface area of the web. More particularly, in most applications, the bonding material will cover from about 20 to about 60 percent of the surface area of the web. The total amount of bonding material applied to of the web can be in the range of from about 1 to about 25 percent by weight, such as from about 2 to about 10 percent by weight, based upon the total weight of the web.

At the above amounts, the bonding materials can penetrate the paper web from about 10 to about 70 percent of the total thickness of the web. In many applications, the bonding material may penetrate from about 10 to about 15 percent of the thickness of the web.

The process that is used to apply the bonding materials to the paper web in accordance with the present invention can vary. For example, various printing methods can be used to print the bonding materials onto the base sheet depending upon the particular application. Such printing methods can include direct gravure printing, offset gravure or flexographic printing.

In the embodiment shown in FIG. 3 only one side of the web is treated with a bonding material leaving an untreated side. Leaving one side of the tissue web untreated may provide various benefits and advantages under some circumstances. For instance, the untreated side may increase the ability of the tissue web to absorb liquids faster. Further, the untreated side may have a greater texture than if the side were treated with a bonding material.

According to the process of the current invention, numerous and different tissue products can be formed. For instance, the tissue products may be single-ply wiper products. The products can be, for instance, facial tissues, bath tissues, paper towels, napkins, industrial wipers, and the like. As stated above, the basis weight can range anywhere from about 10 gsm to about 120 gsm. In one particular embodiment, the present invention is directed to the production of a single ply paper towel product having a basis weight of from about 35 to about 80 gsm.

Tissue products made according to the present invention may have a relatively high bulk. Tissue products made in accordance with the present invention, for instance, may have a bulk greater than 10 cc/g. For example, in one embodiment, the bulk of tissue products made according to the present invention can be greater than about 11 cc/g, such as greater than about 12 cc/g.

In an alternative embodiment, tissue webs made according to the present invention can be incorporated into multiple ply products. For instance, in one embodiment, a tissue web made according to the present invention can be attached to one or more other tissue webs for forming a wiping product having desired characteristics. The other webs laminated to the tissue web of the present invention can be, for instance, a wet-creped web, a calendered web, an embossed web, a through-air dried web, a creped through-air dried web, an uncreped through-air dried web, an airlaid web, and the like.

Test Methods

Slough

Slough is a tendency of a tissue sheet to shed fibers or clumps of fibers when rubbed or otherwise handled. The slough test provides a quantitative measure of the abrasion resistance of a tissue sample. More specifically, the test measures the resistance of a material to an abrasive action when the material is subjected to a horizontally reciprocating surface abrader. The equipment and method used is similar to that described in U.S. Pat. No. 6,808,595, the disclosure of which is herein incorporated by reference to the extent that it is non-contradictory herewith.

FIG. 3 of U.S. Pat. No. 6,808,595 illustrates the test equipment used to measure pilling. Shown is the abrading spindle or mandrel, a double arrow showing the motion of the mandrel, a sliding clamp, a slough tray, a stationary clamp, a cycle speed control, a counter, and start/stop controls. The abrading spindle consists of a stainless steel rod, 0.5 inches in diameter with the abrasive portion consisting of a 0.005 inches deep diamond pattern knurl extending 4.25 inches in length around the entire circumference of the rod. The abrading spindle is mounted perpendicularly to the face of the instrument such that the abrasive portion of the abrading spindle extends out its entire distance from the face of the instrument. On each side of the abrading spindle is located a pair of clamps, one movable and one fixed, spaced 4 inches apart and centered about the abrading spindle. The movable clamp (weighing approximately 102.7 grams) is allowed to slide freely in the vertical direction, the weight of the movable clamp providing the means for insuring a constant is tension of the tissue sheet sample over the surface of the abrading spindle.

Prior to testing, all tissue sheet samples are conditioned at 23±1° C. and 50±2 percent relative humidity for a minimum of 4 hours. Using a JDC-3 or equivalent precision cutter, available from Thwing-Albert Instrument Company, Philadelphia, PA, the tissue sheet sample specimens are cut into 3±0.05 inches wide×7 inches long strips (note: length is not critical as long as specimen can span distance so as to be inserted into the clamps). For tissue sheet samples, the MD direction corresponds to the longer dimension. Each tissue sheet sample is weighed to the nearest 0.1 mg. One end of the tissue sheet sample is clamped to the fixed clamp, the sample then loosely draped over the abrading spindle or mandrel and clamped into the sliding clamp. The entire width of the tissue sheet sample should be in contact with the abrading spindle. The sliding clamp is then allowed to fall providing constant tension across the abrading spindle.

The abrading spindle is then moved back and forth at an approximate 15 degree angle from the centered vertical centerline in a reciprocal horizontal motion against the tissue sheet sample for 20 cycles (each cycle is a back and forth stroke), at a speed of 170 cycles per minute, removing loose fibers from the surface of the tissue sheet sample. Additionally the spindle rotates counter clockwise (when looking at the front of the instrument) at an approximate speed of 5 RPMs. The tissue sheet sample is then removed from the jaws and any loose fibers on the surface of the tissue sheet sample are removed by gently shaking the tissue sheet sample. The tissue sheet sample is then weighed to the nearest 0.1 mg and the weight loss calculated. Ten tissue sheet specimens per sample are tested and the average weight loss value in milligrams (mg) is recorded, which is the Slough value for the side of the tissue sheet being tested.

Generally as slough values reported herein are for the side of the tissue sample that has not been subjected to treatment with a creping material, such as binder, and has not been brought into contacting with the creping surface, such as a Yankee dryer.

Tensile

Tensile testing was done in accordance with TAPPI test method T-576 "Tensile properties of towel and tissue products (using constant rate of elongation)" wherein the testing is conducted on a tensile testing machine maintaining a constant rate of elongation and the width of each specimen tested is 3 inches. More specifically, samples for dry tensile strength testing were prepared by cutting a 3 inches±0.05 inches (76.2 mm±1.3 mm) wide strip in either the machine direction (MD) or cross-machine direction (CD) orientation using a JDC Precision Sample Cutter (Thwing-Albert Instrument Company, Philadelphia, PA, Model No. JDC 3-10, Serial No. 37333) or equivalent. The instrument used for measuring tensile strengths was an MTS Systems Sintech 11S, Serial No. 6233. The data acquisition software was an MTS TestWorks® for Windows Ver. 3.10 (MTS Systems Corp., Research Triangle Park, NC). The load cell was selected from either a 50 Newton or 100 Newton maximum, depending on the strength of the sample being tested, such that the majority of peak load values fall between 10 to 90 percent of the load cell's full scale value. The gauge length between jaws was 4±0.04 inches (101.6±1 mm) for facial tissue and towels and 2±0.02 inches (50.8±0.5 mm) for bath tissue. The crosshead speed was 10±0.4 inches/min (254±1 mm/min), and the break sensitivity was set at 65 percent. The sample was placed in the jaws of the instrument, centered both vertically and horizontally. The test was then started and ended when the specimen broke. The peak load was recorded as either the "MD tensile strength" or the "CD tensile strength" of the specimen depending on the direction of the sample being tested. Ten representative specimens were tested for each product or sheet and the arithmetic average of all individual specimen tests was recorded as the appropriate MD or CD tensile strength the product or sheet in units of grams of force per 3 inches of sample. The geometric mean tensile (GMT) strength was calculated and is expressed as grams-force per 3 inches of sample width. Tensile energy absorbed (TEA) and slope are also calculated by the tensile tester. TEA is reported in units of gm·cm/cm$^2$. Slope is recorded in units of grams (g) or kilograms (kg). Both TEA and Slope are directional dependent and thus MD and CD directions are measured independently. Geometric mean TEA and geometric mean slope are defined as the square root of the product of the representative MD and CD values for the given property.

EXAMPLES

A pilot tissue machine was used to produce a layered, uncreped through-air dried ("UCTAD") towel basesheet in accordance with this invention generally as described in FIG. 2. After manufacture on the tissue machine, the UCTAD basesheet was printed on one side with a latex-based binder. The binder-treated sheet was adhered to the surface of a Yankee dryer to re-dry the sheet and thereafter the sheet was creped and wound onto a roll without any additional thermal curing. The resulting sheet was converted into rolls of single-ply paper towels in a conventional manner.

More specifically, the basesheet was made from a stratified fiber furnish containing a center layer of fibers (40 percent by weight of the web) positioned between two outer layers of fibers (each outer layer comprising 30 percent by weight of the web). The fiber furnish consisted of Northern softwood kraft (NSWK), Southern softwood kraft (SSWK) and Eucalyptus hardwood kraft (EHWK). The first outer layer contacted the through-air drying fabric during manufacture (fabric layer) and the second outer layer (air layer) has treated with binder and contacted the Yankee dryer. The furnish composition of each layer is summarized in Table 1, below. The weight percentages in Table 1 reflect the weight percentage of a given fibrous layer. In all instances the furnish forming the first outer layer was subjected to refining. A debonding agent (ProSoft® TQ1003, Solenis, Wilmington, DE) was added to the furnish forming the middle and air layers as set forth in Table 1, below. Each of the layers were also treated 2.0 kg/MT of wet strength additive (Kymene 920A, Solenis, Wilmington, DE) and 1.0 kg/MT carboxymethyl cellulose (CMC).

TABLE 1

| Sample | First Outer Layer (wt %) | Middle Layer (wt %) | Second Outer Layer (wt %) | ProSoft ® TQ1003 (kg/MT) |
|---|---|---|---|---|
| 1 | NSWK (100%) | NSWK (72%)<br>SSWK (28%) | NSWK (72%)<br>SSWK (28%) | 5.35 |
| 2 | NSWK (67%)<br>EHWK (33%) | NSWK (72%)<br>SSWK (28%) | NSWK (72%)<br>SSWK (28%) | 4.9 |
| 3 | NSWK (33%)<br>EHWK (67%) | NSWK (72%)<br>SSWK (28%) | NSWK (72%)<br>SSWK (28%) | 4.45 |
| 4 | EHWK (100%) | NSWK (72%)<br>SSWK (28%) | NSWK (72%)<br>SSWK (28%) | 3.55 |

The machine-chest furnish containing the chemical additives was diluted to approximately 0.2 percent consistency and delivered to a layered headbox. The basesheet was then rush transferred to a transfer fabric (Fred, described in U.S. Pat. No. 7,611,607 and commercially available from Voith Fabrics, Appleton, WI) traveling 15 percent slower than the forming fabric using a vacuum roll to assist the transfer. At a second vacuum-assisted transfer, the basesheet was transferred and wet-molded onto the throughdrying fabric (T1205-2, described in U.S. Pat. No. 8,500,955 and commercially available from Voith Fabrics, Appleton, WI). The sheet was dried with a through-air dryer resulting in a basesheet having an air-dry basis weight of about 45 grams per square meter (gsm).

The resulting sheet was fed to a gravure printing line, traveling at about 1,500 feet per minute where a latex binder was printed onto the second outer layer (air layer) of the sheet. The printed side of the sheet was then pressed against and doctored off a rotating drum, which had a surface temperature of approximately 132° C. Finally the sheet was wound onto a roll without any additional thermal curing.

The latex binder material in this example was a carboxylated vinyl acetate-ethylene terpolymer, Vinnapas EP1133 (Wacker Chemie AG, Allentown, PA). The add-on amount of the binder applied to the sheet was approximately 7 weight percent. The resulting tissue product was subjected to physical testing, the results of which are summarized in Table 2, below. The slough value is reported for the side of the product not treated with binder.

TABLE 2

| | Sample 1 | Sample 2 | Sample 3 | Sample 4 |
|---|---|---|---|---|
| Basis Wt. (gsm) | 43.5 | 43.6 | 44.2 | 45.2 |
| Caliper (μm) | 958 | 980 | 970 | 973 |
| GMT (g/3") | 1532 | 1443 | 1451 | 1590 |
| Tensile Ratio | 1.9 | 1.8 | 2 | 1.9 |
| GM Stretch (%) | 11.4 | 10.9 | 11.0 | 10.3 |
| GM Slope (g) | 9382 | 9436 | 10056 | 12315 |
| Stiffness Index | 6.12 | 6.54 | 6.93 | 7.75 |
| GM TEA (g*cm/cm$^2$) | 10.6 | 9.9 | 10.1 | 10.6 |
| TEA Index | 6.93 | 6.83 | 6.98 | 6.67 |
| Slough (mg) | 9.34 | 9.18 | 8.76 | 7.10 |

While the invention has been described in detail with respect to the specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto and the following embodiments:

In a first embodiment the present invention provides a tissue product comprising a multi-layered web having a first outer fibrous layer comprising long cellulosic fibers forming an upper surface of the product and a second outer fibrous layer comprising short, low coarseness cellulosic fibers forming the bottom surface of the product and a middle layer disposed there between; and a binder disposed on the upper surface of the product, wherein the bottom surface of the tissue product has a slough less than about 9.0 mg.

In a second embodiment the present invention provides the tissue product of the first embodiment wherein the short, low coarseness cellulosic fibers have a fiber length less than about 2.0 mm.

In a third embodiment the present invention provides the tissue product of the first or the second embodiments wherein the short, low coarseness cellulosic fibers have a coarseness less than about 17 mg/100 m.

In a fourth embodiment the present invention provides the tissue product of any one of the first through the third embodiments wherein the short, low coarseness cellulosic fibers have a fiber length from about 0.5 to about 1.0 mm and a coarseness from about 5.0 to about 12.0 mg/100 m.

In a fifth embodiment the present invention provides the tissue product of any one of the first through the fourth embodiments wherein the short, low coarseness cellulosic fibers are hardwood kraft pulp fibers.

In a sixth embodiment the present invention provides the tissue product of any one of the first through the fourth embodiments wherein the second outer fibrous layer consists essentially of hardwood kraft pulp fibers derived from a fiber source selected from the group consisting of Acacia, Eucalyptus, Maple, Oak, Aspen, Birch, Cottonwood, Alder, Ash, Cherry, Elm, Hickory, Poplar, Gum, Walnut, Locust, Sycamore, Beech, Catalpa, Sassafras, Gmelina, Albizia, Anthocephalus, and Magnolia.

In a seventh embodiment the present invention provides the tissue product of any one of the first through the sixth embodiments wherein the bottom surface has a slough from about 6.0 to about 9.0 mg.

In an eighth embodiment the present invention provides the tissue product of any one of the first through the seventh embodiments having a geometric mean tensile strength (GMT) from about 1,000 to about 1,750 g/3", a basis weight from about 40 to about 60 grams per square meter (gsm) and a sheet bulk greater than about 10 cc/g.

In a ninth embodiment the present invention provides the tissue product of any one of the first through the eighth embodiments having a TEA Index greater than about 6.5.

In a tenth embodiment the present invention provides the tissue product of any one of the first through the ninth embodiments wherein the bottom surface has a slough from about 6.0 to about 8.0 mg.

In an eleventh embodiment the present invention provides the tissue product of any one of the first through the tenth embodiments wherein the bottom surface has a slough from about 6.0 to about 7.5 mg.

In a twelfth embodiment the present invention provides the tissue product of any one of the first through the eleventh embodiments wherein the second outer fibrous layer consists essentially of hardwood kraft pulp fibers and the second outer fibrous layer comprises from about 10 to about 40 weight percent of the tissue product.

In a thirteenth embodiment the present invention provides the tissue product of any one of the first through the twelfth embodiments wherein the tissue product consists of a single ply and the multi-layered web is a through-air dried web.

What is claimed is:

1. A method of forming a durable multi-ply tissue product comprising the steps of:

a. dispersing short, low coarseness pulp fibers in water to form a first fiber slurry;

b. dispersing long pulp fibers in water to form a second fiber slurry;

c. dispersing long pulp fibers in water form a third fiber slurry;

d. depositing the first, second and third fiber slurries in a layered arrangement on a moving belt to form a multi-layered tissue web, wherein the first fiber slurry contacts the moving belt and forms a first outer surface of the web and the third fiber slurry contacts air and forms a second outer surface of the web and the second fiber slurry is disposed between the first and third fiber slurries;

e. applying a binder to the second outer surface of the web according to a first preselected pattern;

f. creping the second outer surface of the web after application of the binder; and g. converting the creped web into a tissue product wherein the first outer surface has a slough less than about 9.0 mg.

2. The method of claim 1 wherein the short, low coarseness cellulosic fibers have a fiber length from about 0.5 to about 1.0 mm and a coarseness from about 5.0 to about 12.0 mg/100 m.

3. The method of claim 1 further comprising the step of adding a debonder selected from the group consisting of an imidazoline quaternary compound, an ester-functional quaternary ammonium compound, or mixtures thereof, to the second fiber slurry.

4. The method of claim 1 wherein the binder comprises an ethylene vinyl acetate copolymer or a carboxylated vinyl acetate-ethylene terpolymer.

5. The method of claim 1 further comprising the step of refining the first fiber slurry.

6. The method of claim 1 wherein the short, low coarseness pulp fibers are hardwood kraft pulp fibers.

7. The method of claim 1 wherein the short, low coarseness pulp fibers are hardwood kraft pulp fibers derived from a fiber source selected from the group consisting of Acacia, Eucalyptus, Maple, Oak, Aspen, Birch, Cottonwood, Alder, Ash, Cherry, Elm, Hickory, Poplar, Gum, Walnut, Locust, Sycamore, Beech, Catalpa, Sassafras, Gmelina, Albizia, Anthocephalus, and Magnolia.

8. The method of claim 1 wherein the long pulp fibers are softwood kraft pulp fibers.

9. The method of claim 1 wherein the amount of first fiber slurry deposited is such that the resulting multi-layered tissue web comprises from about 25 to about 35 percent by weight short, low coarseness cellulosic fibers.

10. The method of claim 1 wherein the tissue product has a geometric mean tensile strength (GMT) from about 1,000 to about 1,750 g/3", a basis weight from about 40 to about 60 grams per square meter (gsm) and a sheet bulk greater than about 10 cc/g.

11. The method of claim 1 wherein the tissue product has a TEA Index greater than about 6.5.

* * * * *